United States Patent [19]

Catan

[11] 4,289,190

[45] Sep. 15, 1981

[54] PLASTIC STRIP CLOSURES AND METHODS OF PROTECTING THE SAME

[75] Inventor: Robert Catan, Smithtown, N.Y.

[73] Assignee: Dynaforce Corporation, Old Bethpage, N.Y.

[21] Appl. No.: 6,851

[22] Filed: Jan. 26, 1979

[51] Int. Cl.[3] ..... A47H 1/00; A47H 23/00

[52] U.S. Cl. ..... 160/332; 160/184

[58] Field of Search ..... 160/330, 332, 184, 345

[56] References Cited

U.S. PATENT DOCUMENTS

| | | | |
|---|---|---|---|
| 2,122,532 | 7/1938 | Mims et al. | 160/330 |
| 2,642,683 | 5/1953 | Meyer, Jr. | 160/332 |
| 3,272,257 | 9/1966 | Dirubbo | 160/354 |
| 4,086,950 | 5/1978 | Power | 160/332 |

FOREIGN PATENT DOCUMENTS

| | | | |
|---|---|---|---|
| 975286 | 9/1975 | Canada | 160/332 |
| 6933363 | 2/1970 | Fed. Rep. of Germany . | |
| 1308952 | 10/1962 | France . | |
| 7046597 | 7/1972 | France . | |
| 882638 | 11/1961 | United Kingdom . | |

OTHER PUBLICATIONS

Nieco Flexible Strip Doors.
Payne Safe-Snap.

*Primary Examiner*—Rodney H. Bonck
*Attorney, Agent, or Firm*—Posnack, Roberts, Cohen & Spiecens

[57] ABSTRACT

A bumper strip is employed for obturating an opening. A plurality of such bumper strips may be suspended in depending overlapping relationship in an opening to close the same. Alternatively, the closure may be provided by mounting a plurality of such closure strips on a hinged door arrangement. The bumper strips protect the opening and are preferably transparent. The transparency is protected by having ribs arranged to receive the impact of objects passing through the opening whereby the faces of the strips are protected from abrasion. The strips may be suspended in depending relationship by angles provided with studs which pass through the strips and which receive retaining devices clamping the strips thereon. The studs may be supported on a slidable strip which is accommodated in a track.

10 Claims, 7 Drawing Figures

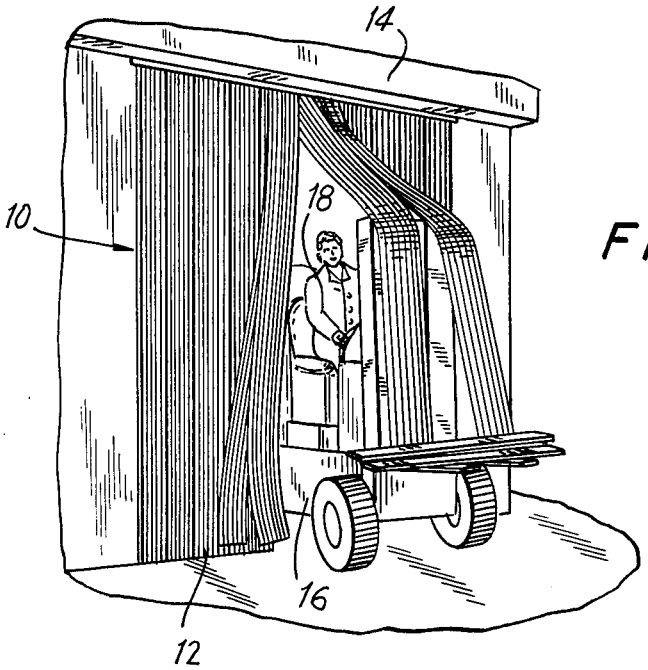
FIG. 1
FIG. 2
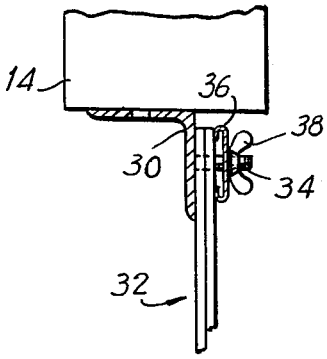
FIG. 3
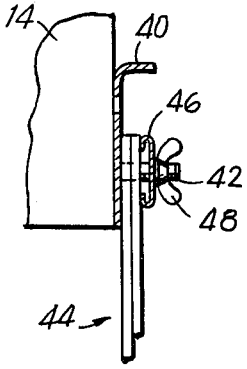
FIG. 4
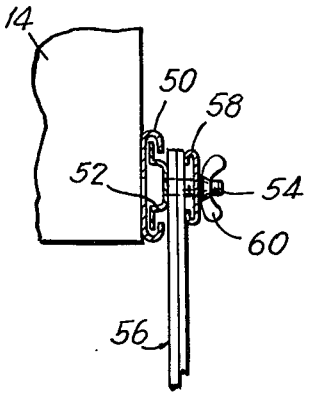

PLASTIC STRIP CLOSURES AND METHODS OF PROTECTING THE SAME

FIELD OF INVENTION

This invention relates to articles of manufacture such as strips of plastic material useful in connection with closures and, more particularly, to strips useful in forming curtain type closures as well as strips useful with conventional door constructions.

BACKGROUND

A curtain-type closure is disclosed, for example, in U.S. Pat. No. 4,086,950 (H. Power). Therein is disclosed a doorway screen having a support extending transversely above a doorway opening. A plurality of individual flexible pastic strips or panels are secured to and suspended from the support. The strips are formed to have in horizontal cross-section a relatively thin straight central portion merging at the end edges with relatively thick bulbous or enlarged ends in the form of beads. The strips or panels are disposed to overlap each other with the end edges of one strip in abutting relationship with the straight portion of an adjacent strip to define discrete pockets between adjacent end edges. One of the difficulties in the aforesaid arrangement has to do with the material employed. The strips being provided with bulbous edges have no completely planar faces and, when the strips are supplied in rolled form, the material has the tendency to bow, and, as a consequence, is not stable in coiled form. In addition, the strips, when placed in overlapping relationship, have only linear contact with one another and do not have a face-to-face contacting relationship which means that an adequate seal is not provided. In addition, the strips of the Power patent are arranged with the bulbous portions constituting the only rib-like members on the respective faces. Consequently, engagement with a central portion of such strip construction is readily possible with the resultant disadvantage that the flat surfaces thereof are marred and the transparency characteristics of such strips are readily deteriorated.

The same deficiency is readily apparent in the type of construction illustrated in Canadian Pat. No. 975,286. In this patent, the strips make contacts at their respective ends through the intermediary of bulbous portions and the central portions of the strips are devoid of ribs or any other protective agency whereby a marring of the transparency thereof might be avoided.

Other patents relating generally to the subject matter of the present invention, without being anticipatory thereof, include British Pat. No. 824,402; British Pat. No. 882,638; French Pat. No. 1,308,952; French Pat. No. 1,508,336; and German Pat. No. 2,311,595. Some publications disclosing suspension arrangements of the same general nature as those to be discussed hereinunder are to be found in Catalogue SD-1-77-75M of the Nieco Company of Burlingame, Calif. and the Safe-Snap tape and track catalogue of Payne & Company of Dayton, Ohio (copyright Registration A381448).

SUMMARY OF INVENTION

It is an object of the invention to provide improved closures for obturating openings.

It is another object of the invention to provide improved curtain type closures.

Still another object of the invention is to provide improved closures incorporating conventional door structures.

It is a further object of the invention to provide improved bumper strip designs for purposes of reducing the abrasion of such strips and protecting the transparency thereof.

It is still another object of the invention to provide improved bumper strip designs to provide for more readily passing objects which are travelling through openings by minimizing the friction therewith.

Still another object of the invention is to provide improved bumper strip designs for maintaining the surfaces of such strips in a clearer condition then heretofore possible.

Yet another object of the invention is to provide improved bumper strip designs which add structural stability to the strip material.

Still another object of the invention is to provide improved bumper strip designs to enhance the see-through capability of the structures constructed therewith.

The invention provides more particularly for the positive temperature separation of spaces and for the effective containment of dust fumes, smoke, dirt and noise. The invention furthermore provides for minimizing the scratching and abrasions to which bumper strips are subject in operation. Furthermore, the invention provides for simple mounting features allowing rearrangement of overlap in the curtain type closure of the invention and moreover provides for minimizing maintenance except for an occasional cleaning which may be required. Still further, the invention provides for minimal labor in mounting and for a slip-on design which makes installation relatively simple and of extremely low cost.

In achieving the above and other objects of the invention, there is provided, in accordance with one embodiment thereof, a curtain type closure comprising a plurality of strips with means to suspend said strips in depending and overlapping relationship to obturate the associated opening, said strips being of flexible material to permit the passage of objects through the opening, said material having projections thereon for engagement by said objects.

Said strips may, furthermore, be monolithic with the projections, the strips being preferably of a transparent material such as polyvinyl chloride.

In accordance with a preferred embodiment of the invention, the projections are ribs extending longitudinally along the strips. Moreover, the strips may preferably have lateral edges and have selected of said projections closely adjacent these lateral edges.

In accordance with the specific features of the invention, the strips are preferably in the order of about 0.120 inches thick. Moreover, the strips are preferably in the order of about 12 inches wide. Still further, the ribs may preferably be spaced by about 2 inches.

Said strips may additionally be arranged generally in two planes and, according to one embodiment, the strips in each plane may substantially over the strips in the other plane but are staggered relative thereto. In accordance with a further embodiment of the invention, the strips in each plane overlap about $\frac{2}{3}$ the area of the strips in the other plane and are staggered relative thereto.

The ribs noted hereinabove are preferably about 3/16 of an inch in height and the ribs on the strips in each of the aforesaid planes preferably protrude away from the strips in the other plane.

According to a feature of the invention, the aforesaid means may include a metal angle superimposed above said opening, studs on said angle extending through said strips, and retaining devices to retain the strips on the studs. As an alternative, the aforesaid means may include a track superimposed above the opening, a strip slidable in said track, studs on said strip extending through the strips, and retaining devices to retain the strips on the studs. The aforesaid strips may be, preferably, about 10 to 14 feet in height.

According to the invention, from another view point, there is provided apparatus comprising a plurality of strips of clear flexible plastic in the order of ⅜ of an inch in thickness including rectilinear ribs, said ribs extending in parallel and being spaced in the order of about 2 inches and being in the order of about 3/16 of an inch high, said strips having the outermost of said ribs thereof peripherally located, there being provided means to support said strips in an opening to obturate the same.

According to one aspect of the invention, as noted above, the strips may be suspended in depending overlapping relation to form a curtain. In accordance with another embodiment of the invention, the supporting means for the strips may be constituted by doors on which the strips are mounted in face-to-face relationship.

According to yet another aspect of the invention, there is provided a method of protecting the transparency of a plastic strip having a face adapted to be engaged by objects, said method comprising forming ribs on the strip to receive the impact of said objects and protect said face from abrasion.

The above and other objects, features and advantages of the invention will be found in the detailed description which follows hereinafter as illustrated in the accompanying drawing.

BRIEF DESCRIPTION OF DRAWING

In the drawing:

FIG. 1 is a perspective view of a closure in the form of a curtain provided in accordance with a preferred embodiment of the invention;

FIG. 2 is a sectional view of a structure for supending the curtain of FIG. 1;

FIG. 3 is a variation of FIG. 2;

FIG. 4 is a variation of FIGS. 2 and 3;

DETAILED DESCRIPTION

Figure 5:
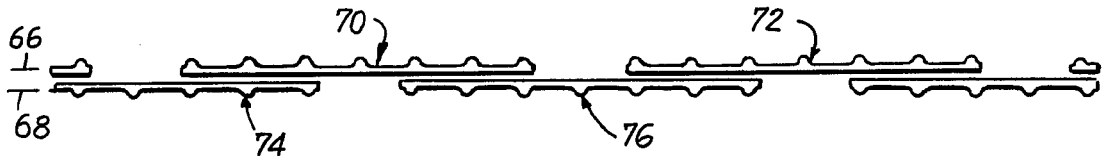
FIG. 5 is a cross-sectional view of the curtain of the invention according to one embodiment thereof.

The preferred product of the invention is known as a "strip" door which employs a staggered series of polyvinyl chloride strips in various arrangements. These strips hang vertically from a support structure mounted above or in an opening. Since they are flexible, they bend as traffic passes through them. The penetration of traffic such as hand trucks, fork lift trucks and so forth will ordinarily abrade and soil the surfaces of the strips reducing the transparency thereof and increasing the wear of the strips.

Inasmuch as visibility is usually an important factor in the use of strip doors, the present invention makes provision to maintain as much visibility as possible while simultaneously providing a bumper strip design to resist wear. The advantages of the invention are in part gained by the utilization of ribs. While these ribs are shown in their preferred round form in the embodiments which follow hereinafter, oval and triangular shapes may as well be employed. These ribs absorb the initial impact of an object hitting the strip while protecting the larger expanse or the face of the clear plastic strip.

It will be clear that the bumper strips of the invention can be formed during an extruding or rolling process and that the ribs are preferably of a spacing and dimension as will be noted hereinafter. Variation of the dimensions and spacing will be possible within the scope of the hereinafter appended claims.

In FIG. 1 is illustrated an opening 10 having thereon a plurality of transparent strips 12 the construction of which will be noted in greater detail hereinafter. The strips are supported in depending relationship from an overhead structure indicated at 14.

Illustrated in FIG. 1 is a fork lift truck 16 having an operator 18 guiding the same through the opening. The fork lift truck will impact against the strips and preferably against the ribs thereon, the transparency of which will be maintained by the provision of the ribs which will absorb the impact and protect the planar surfaces of the strips from abrasion. This will reduce the abrasion of the strip surfaces and provide for the strips' gliding more readily over passing objects. Moreover, the ribs will keep surfaces clearer and will add structural stability to the strip material so that they hang in proper depending relationship from the overhead support.

In addition, these strips will generally be provided in roll form and the ribs are so arranged on the strips that the outermost of the ribs are peripherally located. This arrangement of the strips will prevent the rolled up strip from assuming a concave or convex shape which would make storage of such rolls more difficult.

FIG. 2 illustrates one means by which the strips may be suspended from the overhead structure 14. In accordance with this embodiment of the invention, there is provided a steel angle 30 which may be, for example, a 2" by 2" by ⅛" steel angle which may be nailed or screwed into the overhead structure 14. The strip arrangement is indicated at 32 and it will be seen that a plurality of studs 34 are welded to the angle 30, these studs passing through the strips which are retained thereon by a retaining device consisting of a retainer 36 and a wing nut 38.

According to a further embodiment of the invention as illustrated in FIG. 3, the angle 40 is located on the face of the overhead structure 14 instead of depending therefrom as illustrated in FIG. 2. Once again, a plurality of studs 42 are employed which are welded onto the angle 40. These studs pass through the strip arrangement indicated at 44 and are retained thereon by a retaining device consisting of a retainer 46 and a wing nut 48.

According to the embodiment of the invention as illustrated in FIG. 4, a track 50 is mounted on the face of the overhead structure 14. Within the track is slidably supported a strip 52 on which are mounted a plurality of studs such as indicated at 54. The studs pass through the strip arrangement indicated at 56 and are held thereon by a retaining device consisting of a retainer 58 and a wing nut 60.

In the aforegoing support structures, considerable variation is permitted within the scope of the invention. Thus, for example, it is not necessary to employ retaining devices consisting of wing nuts or the like but instead a wide variety of other clamping mechanisms are permissible within the scope of the invention. Thus, the invention is not limited in any respect to the type of fastening device which is illustrated in FIGS. 2–4.

Figure 6:
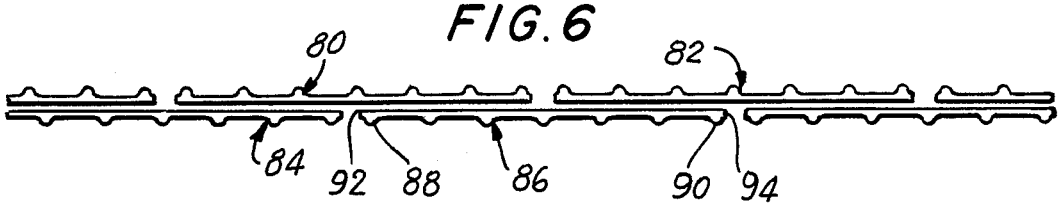
FIG. 6 is a modification of FIG. 6.

FIGS. 5 and 6 illustrate variations in the overlapping arrangement of the bumper strips provided in accordance with the invention. As is illustrated in FIG. 5, for example, the strips are staggered in alternate relationship and are arranged in two parallel planes such as indicated at 66 and 68. More particularly, strips 70 and 72 are arranged in plane 66 and strips 74 and 76 are arranged in plane 68. In the embodiment of the invention illustrated in FIG. 5, the strips in one plane cover approximately $\frac{2}{3}$ of the surface area of the strips arranged in the other plane. This is in contrast to the embodiment of the invention illustrated in FIG. 6 wherein the strips in one plane cover substantially the entire surface area of the strips arranged in the other plane.

More specifically, in FIG. 6 are shown a representative series of bumper strips whereof the bumper strips 80 and 82 are contained in one plane and the bumper strips 84 and 86 are contained in a parallel plane spaced from the first said plane.

Regarding the bumper strips described hereinabove, these are preferably manufactured with the ribs being monolithic with the bodies of the strips themselves. The strips and ribs are preferably manufactured by extrusion or by stamping and are preferably of polyvinyl chloride in the order of about 0.120 inches thickness. A range is possible within the preferred embodiment of the invention and a wider variation in thickness is also possible.

The strips are, moreover, preferably in the order of about 12 inches in width. Other widths are contemplated within the scope of the invention and, for example, strips may be provided in widths of 8, 12 and 16 inches. Other widths are possible within the broader scope of the invention although the above indicates the preferred order of magnitude.

In accordance with the invention, the outermost ribs on any given strip are preferably peripherally located. Referring to FIG. 6 by way of example, it is seen that the outermost ribs are indicated at 88 and 90. The strip itself has lateral edges indicated at 92 and 94. When it is stated that the outermost ribs (e.g., ribs 88 and 90) are peripherally located, what is meant that these ribs are located directly at the lateral edges 92 and 94 and preferably within $\frac{1}{8}$ to $\frac{1}{4}$ of an inch of said edges if not immediately at these edges. The purpose of this, in addition to affording optimum protection of the strips constituting the closure of the invention, is to add structural strength to these strips when they are supplied in rolled form. It has been found that when such strips are provided in rolled form, they have a tendency to assume a concave shape and fall out of the rolled arrangement if the ribs are not arranged in the manner described hereinabove. Accordingly, the preferred embodiment of the invention finds these ribs peripherally located both for purposes of storage and for purposes of optimum protection of the strips in operation. More specifically, with regard to the operation, it will be seen that these ribs tend to protect the strips as objects are passing through the closure such as when the fork lift 16 passes through the closure 10 as illustrated in FIG. 1.

According to another aspect of the invention, the ribs are, according to a preferred embodiment of the invention spaced by about 2 inches in parallel relationship. This spacing relationship may vary widely within the scope of the invention. However, with respect to the preferred embodiment, it is found that a preferred protection against abrasion and for minimizing damage to transparency is in the order of 2 inches.

The ribs are preferably about 3/16 of an inch high. This dimension may also vary in accordance with the broadest concept of the invention. Nevertheless, the specified height of 3/16 of an inch is preferred to give the maximum protection while interfering at a minimum with the flexibility of the bumper strips provided in accordance with the invention.

It will be noted that in accordance with still another aspect of the invention and as particularly illustrated in FIGS. 5 and 6, the ribs on the respective strips extend in preferred direction. Thus, the ribs on the strips in one plane (e.g., the plane 66 in FIG. 5) extend away from the strips in the plane 88. On the other hand, the ribs on the strips in the plane 66 extend away from the ribs on the strips in the plane 66.

The preferred thickness of the strips of the invention is in the order of 0.120 inches which gives an optimum transparency and optimum resistance to deterioration from objects passing through the openings which are treated in accordance with the invention.

Figure 7:
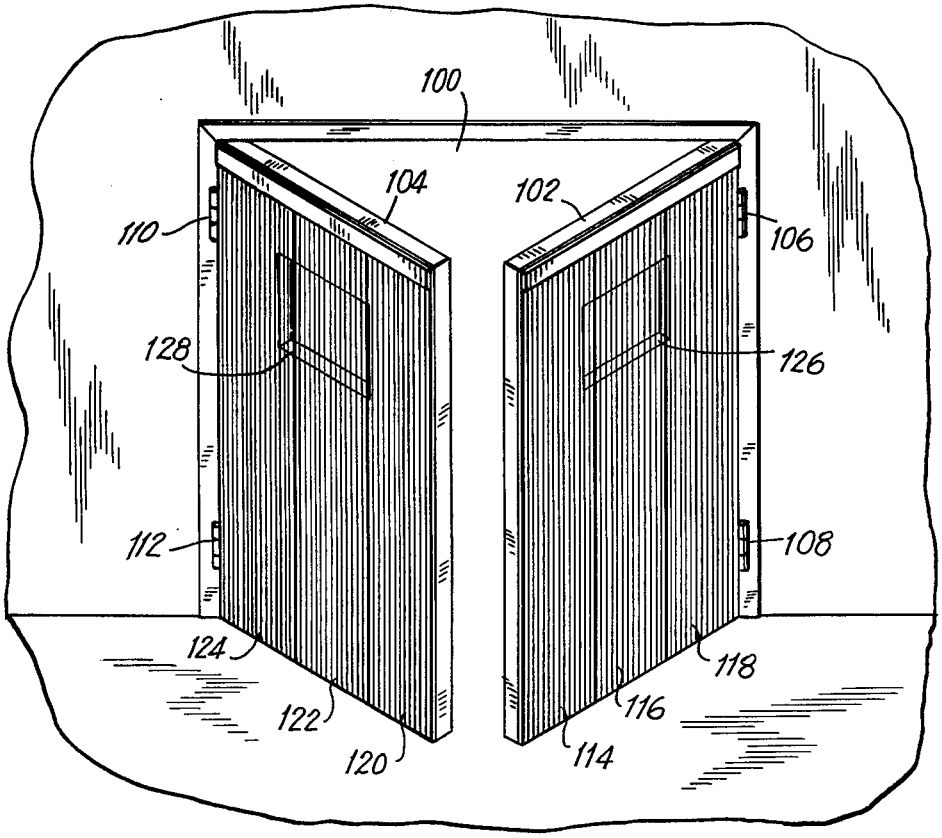
FIG. 7 illustrates a second type of closure employing the bumper strips of the invention according to a further embodiment of the invention.

A further use of the bumper strips of the invention is illustrated in FIG. 7. Therein, an opening 100 having doors 102 and 104 arranged on hinges 106,108, 110 and 112 are provided with bumper strips manufactured in accordance with the invention.

In FIG. 7, by way of example, as shown on the door 102, the strips 114,116 and 118 are nailed or fastened by adhesive to the door 102 in face-to-face relationship therewith with the strips' being arranged in edgewise abutting relationship. It is preferred that the entire door be so covered but, in accordance with the invention, it is possible to cover only a portion of the door.

The door 104 is similarly shown covered by strips 120, 122 and 124 these strips also being in face-to-face relationship with the door 104 and in edgewise abutting relationship with each other.

As in the previous embodiment of the invention, the strips which are employed in FIG. 7 are provided with a plurality of raised projections or ribs, these ribs being formed according to the dimensions and ranges specified hereinabove. The purpose of these strips is, as aforesaid, to minimize damage and to resist abrasion to the faces of the strips thereby to enable the maintaining of optimized visibility through windows in the door such as the windows indicated at 126 and 128.

According to the invention, there is thus also provided a method of protecting the transparency of a plastic strip having a face adapted to be engaged by objects such as fork lift trucks, hand trucks and so forth, said method comprising forming ribs on the strip to receive the impact of said objects and to protect said face from abrasion.

There will now be obvious to those skilled in the art many modifications and variations of the structures and methods set forth hereinabove. These modifications and variations will not depart from the scope of the invention if defined by the following claims.

What is claimed is:

1. A closure for an opening, said closure comprising a plurality of strips, and means to suspend said strips in depending and overlapping relation to obturate said opening, said strips being of flexible material to permit the passage of objects through the opening, said strips being substantially transparent and including projections thereon for engagement by said objects, said strips having opposite planar faces with the projections being located on only one of said faces, the strips having lateral edges and having selected of said projections closely adjacent said lateral edges and other of the projections betwen said edges, said projections being ribs extending longitudinally along said strips, said ribs being spaced at an order of magnitude of about two inches whereby to maximize clarity of said closure and minimize scratching thereof, said strips being arranged in generally two planes, the strips in each plane substantially covering the strips in the other plane but being staggered relative thereto, the ribs on the strips in each plane protruding away from the strips in the other plane whereby the faces of the strips facing one another are planar.

2. A closure as claimed in claim 1 wherein the projections and strips are monolithic.

3. A closure as claimed in claim 1 wherein said strips are of polyvinyl chloride in the order of about 0.120" thick.

4. A closure as claimed in claim 1 wherein said strips are in the order of about twelve inches wide.

5. A closure as claimed in claim 1 wherein the strips in each plane overlap about two-thirds of the area of the strips in the other plane and are staggered relative thereto.

6. A closure as claimed in claim 1 wherein the ribs are about three-sixteenths of an inch high.

7. A closure as claimed in claim 1 wherein said means includes a metal angle superposed about said opening, studs on said angle extending through said strips, and retaining means to retain the strips on the studs.

8. A closure as claimed in claim 1 wherein said means includes a track superposed above said opening, a strip slidable in said track, studs on said strip extending through said strips and retaining means to retain the strips on the studs.

9. A closure as claimed in claim 1 wherein the strips are about ten to fourteen feet tall.

10. A closure as claimed in claim 1 wherein said means includes doors on which said strips are mounted in face-to-face relation.

* * * * *